US010210816B2

(12) United States Patent
Morimoto

(10) Patent No.: US 10,210,816 B2
(45) Date of Patent: Feb. 19, 2019

(54) IMAGE DISPLAY APPARATUS AND METHOD FOR DIMMING LIGHT SOURCE

(71) Applicant: NEC Display Solutions, Ltd., Tokyo (JP)

(72) Inventor: Takeshi Morimoto, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 15/504,694

(22) PCT Filed: Sep. 22, 2014

(86) PCT No.: PCT/JP2014/075085

§ 371 (c)(1),
(2) Date: Feb. 17, 2017

(87) PCT Pub. No.: WO2016/046885

PCT Pub. Date: Mar. 31, 2016

(65) Prior Publication Data

US 2017/0270872 A1 Sep. 21, 2017

(51) Int. Cl.
*G09G 3/34* (2006.01)

(52) U.S. Cl.
CPC ..... *G09G 3/3406* (2013.01); *G09G 2320/062* (2013.01); *G09G 2320/0626* (2013.01); *G09G 2320/0646* (2013.01); *G09G 2360/145* (2013.01); *G09G 2360/16* (2013.01)

(58) Field of Classification Search
None
See application file for complete search history.

(56) References Cited

U.S. PATENT DOCUMENTS

2005/0264702 A1* 12/2005 Yoshii ..... G09G 3/3406 348/687
2011/0063515 A1* 3/2011 Kobayashi ..... G06T 5/003 348/625

FOREIGN PATENT DOCUMENTS

CN 101038731 A 9/2007
CN 101364384 A 2/2009
CN 101399011 A 4/2009
(Continued)

OTHER PUBLICATIONS

International Search Report (ISR) (PCT Form PCT/ISA/210), in PCT/JP2014/075085, dated Jan. 6, 2015.
(Continued)

*Primary Examiner* — Gustavo Polo
(74) *Attorney, Agent, or Firm* — McGinn IP Law Group, PLLC.

(57) ABSTRACT

An image display apparatus (and a method for dimming a light source) includes a light source and display units that spatially modulate a light from the light source on the basis of an input video signal to form an image, and performs dimming control to adjust luminance of the light source in stages. The image display apparatus includes a light source dimming unit that determines whether to perform dimming control on the basis of the input video signal, acquires a dimming rate, which is a ratio of brightness of an input image to a maximum luminance output from the light source, and sets the output of the light source to the maximum luminance output when a dimming rate of a frame immediately before a frame determined not to be subjected to dimming control is lower than a threshold.

6 Claims, 11 Drawing Sheets

(56) References Cited

FOREIGN PATENT DOCUMENTS

| | | | |
|---|---|---|---|
| JP | 2002-357810 | A | 12/2002 |
| JP | 2005-094330 | A | 4/2005 |
| JP | 2006-262031 | A | 9/2006 |
| JP | 2006-285089 | A | 10/2006 |
| JP | 2007-140436 | A | 6/2007 |
| JP | 2008-046572 | A | 2/2008 |
| JP | 2009-086133 | A | 4/2009 |
| JP | 2011-066540 | A | 3/2011 |
| JP | 2013-250341 | A | 12/2013 |

OTHER PUBLICATIONS

Chinese Office Action dated Dec. 29, 2018 in Chinese Application No. 201480081964.1 with an English translation.

* cited by examiner

IMAGE DISPLAY APPARATUS AND METHOD FOR DIMMING LIGHT SOURCE

TECHNICAL FIELD

The present invention relates to an image display apparatus in which dimming control for adjusting luminance of a light source is performed, and a light source dimming method thereof.

BACKGROUND ART

Among recent image display apparatuses, there is an apparatus that performs dimming control for adjusting luminance of a light on the basis of an input video signal.

Patent Literature 1 discloses a video display apparatus that performs dimming control for increasing/decreasing luminance of a light source in stages according to a feature amount of an input video signal. This video display apparatus has: a display panel; a backlight light source that illuminates the display panel; a feature amount detection unit that detects the feature amount of the input video signal; and a light source control unit that performs dimming control on the basis of the detected feature amount.

The feature amount detection unit detects an average luminance level that is the feature amount of the input video signal for each screen. The average luminance level of a black screen, which is entirely displayed black, is 0%, while the average luminance level of a white screen, which is entirely displayed white, is 100%.

The light source control unit stores a dimming-up step amount that is a step amount for increasing the luminance in stages, and a dimming-down step amount that is a step amount for decreasing the luminance in stages. In view of adaptation of human eyes to brightness, the dimming-up step amount is set to a value larger than that of the dimming-down step amount.

The light source control unit determines target luminance of the backlight light source on the basis of the average luminance level detected by the feature amount detection unit, and compares the target luminance with a current luminance set value of the backlight light source. When the target luminance is larger than the current luminance set value, the light source control unit increases the luminance set value by the dimming-up step amount to increase the luminance of the backlight light source. On the other hand, when the target luminance is smaller than the luminance set value, the light source control unit decreases the luminance set value by the dimming-down step amount to decrease the luminance of the backlight light source.

CITATION LIST

Patent Literature

Patent Literature 1: JP2009-86133A

Disclosure of Invention

In the video display apparatus disclosed in Patent Literature 1, there is a problem described below.

In general, in a system where a video output apparatus such as a DVD (Digital Versatile Disc) player is connected to the video display apparatus to display a video, when a stop button is pressed during video reproduction, a menu screen is displayed after a black screen has been displayed.

As an example, FIG. 1 illustrates a series of frames and dimming values (dimming rates) for the frames from the reproduction stop to the displaying of the menu screen. The dimming value corresponds to the aforementioned target luminance, and the larger the luminance value the higher is the luminance of the backlight light source.

Frames a1, a2 indicate currently reproduced videos, and dimming values of these images are both 60%. Frames a3, a4 indicate black screens displayed during the reproduction stop, and dimming values of these black screens are both 10%. Frames a5, a6 indicate menu screens displayed after the reproduction stop, and dimming values of these menu screens are both 100%.

FIG. 2 illustrates an example of a dimming operation when the series of frames illustrated in FIG. 1 are displayed by the video display apparatus disclosed in Patent Literature 1.

At time t1, the screen is switched from the image of frame a2 to the black screen of frame a3 and, then, at time t2, the screen is switched from the black screen of frame a4 to the menu screen of frame a5. In the example illustrated in FIG. 2, the menu screen is displayed in frame a6 and after.

In the period from time t1 to time t2, the light source control unit decreases the luminance of the backlight light source in stages by the dimming-down step amount. At time t2 and after, the light source control unit increases the luminance of the backlight light source in stages by the dimming-up step amount. At time t3, the luminance of the backlight light source reaches 100%.

When the luminance of the light source is increased in stages by dimming control for a still image such as the menu screen not requiring dimming control, a viewer recognizes a change in luminance of the screen and, as a result, the brightness of the screen makes the viewer feel uncomfortable. In the example illustrated in FIG. 2, during period T1 from time t2 to time t3, dimming control using the dimming-up step amount is performed for the menu screen. Accordingly, during period T1, the brightness of the screen causes the viewer to feel uncomfortable.

As described above, in the video display apparatus disclosed in Patent Literature 1, the dimming control is continued for a prescribed period of time even after the screen has been switched to the menu screen, and thus there is a problem in which the brightness of the screen causes the viewer to feel uncomfortable.

The object of the present invention is to provide an image display apparatus and a method for dimming a light source that are capable of solving the abovementioned problem and preventing a viewer from feeling uncomfortable when viewing a menu screen or other images in which dimming control is not required.

In order to achieve the purpose, according to an aspect of the present invention, there is provided an image display apparatus which is provided with: a light source; and a display unit that spatially modulates a light from the light source on the basis of an input video signal to form an image, and which performs dimming control for adjusting luminance of the light source in stages. The image display apparatus includes a light source dimming unit that determines whether to perform dimming control on the basis of the input video signal, acquires a dimming rate which is a ratio to a maximum luminance output from the light source, and maximizes the luminance of the light source when a dimming rate of a frame immediately before a frame determined not to be subjected to dimming control is lower than a threshold.

According to another aspect of the present invention, there is provided a method for dimming a light source for an image display apparatus which is provided with: the light source; and a display unit that spatially modulates a light from the light source on the basis of an input video signal to form an image, and which performs dimming control for adjusting luminance of the light source in stages. The method includes:

determining whether to perform dimming control on the basis of the input video signal;

acquiring a dimming rate which is a ratio to a maximum luminance output from the light source; and setting the luminance of the light source to be maximum when a dimming rate of a frame immediately before a frame determined not to be subjected to dimming control is lower than a threshold.

DESCRIPTION OF EMBODIMENT

Next, the exemplary embodiments of the present invention will be described with reference to the drawings.

First Exemplary Embodiment

Figure 3:
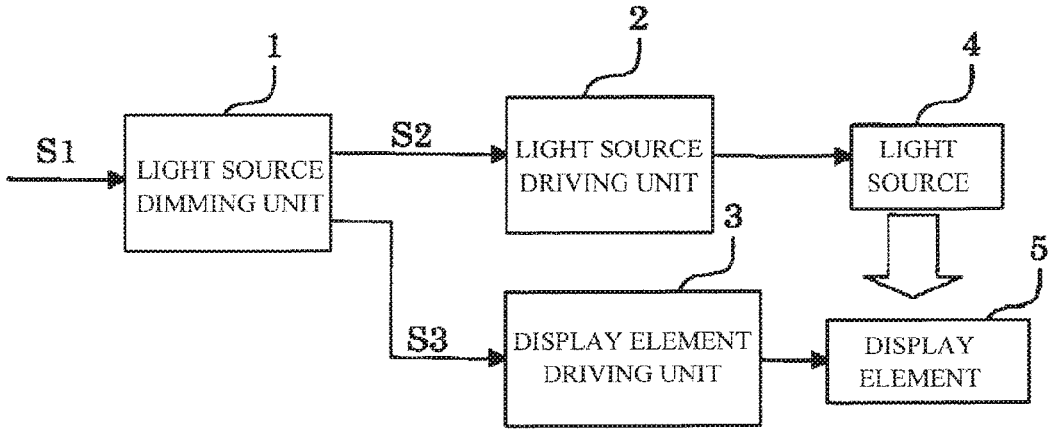
FIG. 3 is a block diagram illustrating components of a main portion of an image display apparatus according to a first exemplary embodiment of the present invention.

FIG. 3 is a block diagram illustrating components of a main portion of an image display apparatus according to an exemplary embodiment of the present invention.

Referring to FIG. 3, the image display apparatus includes light source dimming unit 1, light source driving unit 2, display element driving unit 3, light source 4, and display element 5. For light source 4, a solid light source such as a mercury lamp or a LED (Light Emitting Diode) can be used. Display element 5 is a display element, for example, a liquid crystal display device or a micro-mirror element (DMD), which spatially modulates light from light source 4 to form an image.

Light source dimming unit 1 receives RGB signal S1 from an external video supply apparatus, supplies dimming signal S2 for controlling luminance (or light amount) of light source 4 to light source driving unit 2, and supplies RGB signal S3 for causing display element 5 to display an image to display element driving unit 3. The external video supply apparatus is an information processing apparatus such as a personal computer, or a video output apparatus such as a DVD player or a video recorder.

Light source driving unit 2 drives light source 4 according to dimming signal S2. Display element driving unit 3 drives display element 5 according to RGB signal S3. RGB signal S3 is similar to RGB signal S1, but a delay process has been performed to set time correspondence between RGB signal S3 and dimming signal S2.

Figure 4:
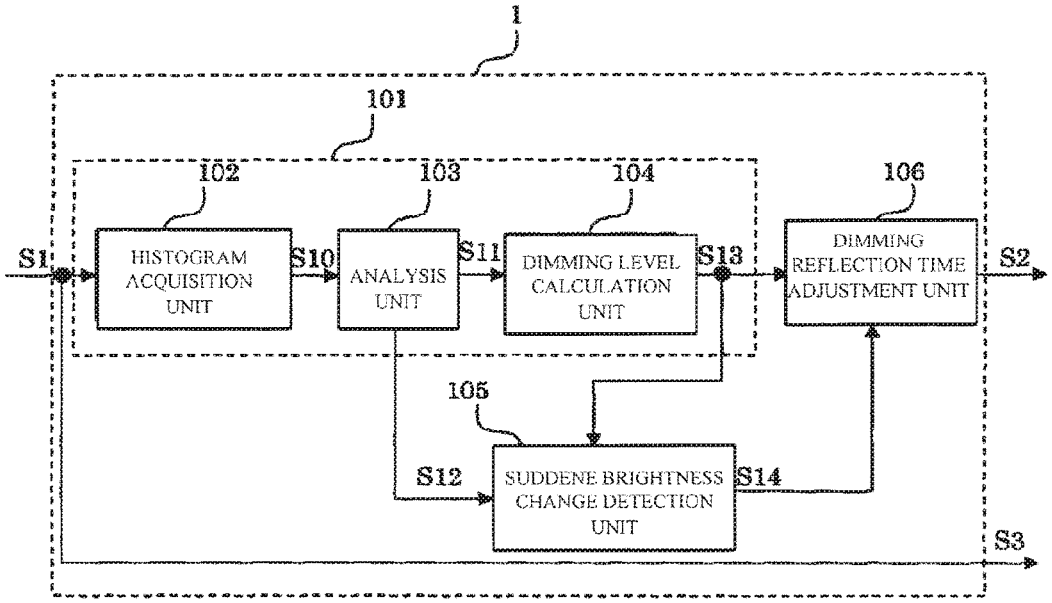
FIG. 4 is a block diagram illustrating components of a light source dimming unit of the image display apparatus illustrated in FIG. 3.

FIG. 4 is a block diagram illustrating components of light source dimming unit 1. Referring to FIG. 4, light source dimming unit 1 includes dimming rate calculation unit 101, sudden brightness change detection unit 105, and dimming reflection time adjustment unit 106. Dimming rate calculation unit 101 includes histogram acquisition unit 102, analysis unit 103, and dimming level calculation unit 104.

RGB signal S1 includes red signal R, green signal G, and blue signal B that are three primary colors of light. Histogram acquisition unit 102 calculates luminance signal Y from RGB signal S1 according to formula (1) below:

$$Y=0.299\times R+0.587\times G+0.114\times B \qquad \text{Formula (1)}$$

In addition, histogram acquisition unit 102 acquires a 16-stage histogram and a 4-stage histogram for each of luminance signal Y, red signal R, green signal G, and blue signal B. In other words, histogram acquisition unit 102 acquires two or more statistical data items. These histograms are acquired by one frame unit.

Hereinafter, an acquisition procedure of the 16-stage histogram when RGB signal S1 is 8-bit digital data will be described.

Histogram acquisition unit 102 includes sixteen registers HistY[0] to HistY[15] for creating a 16-stage histogram regarding luminance signal Y. These registers HistY[0] to HistY[15] are configured to be reset to 0 at the start time of a frame and hold count values at the end time of the frame. Under addition conditions shown in Table 1 below, a count value of a corresponding register among HistY[0] to HistY[15] is added according to input data of luminance signal Y. Accordingly, the 16-stage histogram regarding luminance signal Y can be acquired.

TABLE 1

| NO | Input data | Register to be added |
|---|---|---|
| 0 | 16 > Y ≥ 0 | HistY[0] |
| 1 | 32 > Y ≥ 16 | HistY[1] |
| 2 | 48 > Y ≥ 32 | HistY[2] |
| 3 | 64 > Y ≥ 48 | HistY[3] |
| 4 | 80 > Y ≥ 64 | HistY[4] |
| 5 | 96 > Y ≥ 80 | HistY[5] |
| 6 | 112 > Y ≥ 96 | HistY[6] |
| 7 | 128 > Y ≥ 112 | HistY[7] |
| 8 | 144 > Y ≥ 128 | HistY[8] |

TABLE 1-continued

| NO | Input data | Register to be added |
|---|---|---|
| 9 | 160 > Y ≥ 144 | HistY[9] |
| 10 | 176 > Y ≥ 160 | HistY[10] |
| 11 | 192 > Y ≥ 176 | HistY[11] |
| 12 | 208 > Y ≥ 192 | HistY[12] |
| 13 | 224 > Y ≥ 208 | HistY[13] |
| 14 | 240 > Y ≥ 224 | HistY[14] |
| 15 | 256 > Y ≥ 240 | HistY[15] |

Histogram acquisition unit 102 includes sixteen registers HistR[0] to HistR[15] for red signal R, sixteen registers HistG[0] to HistG[15] for green signal G, and sixteen registers HistB[0] to HistB[15] for blue signal B. These registers HistR[0] to HistR[15], HistG[0] to HistG[15], and HistB[0] to HistB[15] are also configured to be reset to 0 at the start time of a frame and hold count values at the end time of the frame.

Addition conditions of red signal R are, in Table 1, conditions where the registers to be added, namely HistY[0] to HistY[15], are replaced with HistR[0] to HistR[15]. Under theses addition conditions, a count value of a corresponding register among HistR[0] to HistR[15] is added according to input data of red signal R. Accordingly, a 16-stage histogram regarding red signal R can be acquired.

Addition conditions of green signal G are, in Table 1, conditions where the registers to be added, namely HistY[0] to HistY[15], are replaced with HistG[0] to HistG[15]. Under theses addition conditions, a count value of a corresponding register among HistG[0] to HistG[15] is added according to input data of green signal G. Accordingly, a 16-stage histogram regarding green signal G can be acquired.

Addition conditions of blue signal B are, in Table 1, conditions where the registers to be added, namely HistY[0] to HistY[15], are replaced with HistB[0] to HistB[15]. Under theses addition conditions, a count value of a corresponding register among HistB[0] to HistB[15] is added according to input data of blue signal B. Accordingly, a 16-stage histogram regarding blue signal B can be acquired.

In addition, histogram acquisition unit 102 includes four registers HistLY[0] to HistLY[3] for creating a 4-stage histogram regarding luminance signal Y. Count values are added to HistLY[0] to HistLY[3] according to formulas (2) to (5) below. Accordingly, for luminance signal Y, the 4-stage histogram can be calculated from the 16-stage histogram.

$$\mathrm{Hist}LY[0]=\mathrm{Hist}Y[0]+\mathrm{Hist}Y[1]+\mathrm{Hist}Y[2]+\mathrm{Hist}Y[3] \quad \text{Formula (2)}$$

$$\mathrm{Hist}LY[1]=\mathrm{Hist}Y[4]+\mathrm{Hist}Y[5]+\mathrm{Hist}Y[6]+\mathrm{Hist}Y[7] \quad \text{Formula (3)}$$

$$\mathrm{Hist}LY[2]=\mathrm{Hist}Y[8]+\mathrm{Hist}Y[9]+\mathrm{Hist}Y[10]+\mathrm{Hist}Y[11] \quad \text{Formula (4)}$$

$$\mathrm{Hist}LY[3]=\mathrm{Hist}Y[12]+\mathrm{Hist}Y[13]+\mathrm{Hist}Y[14]+\mathrm{Hist}Y[15] \quad \text{Formula (5)}$$

Figure 5:
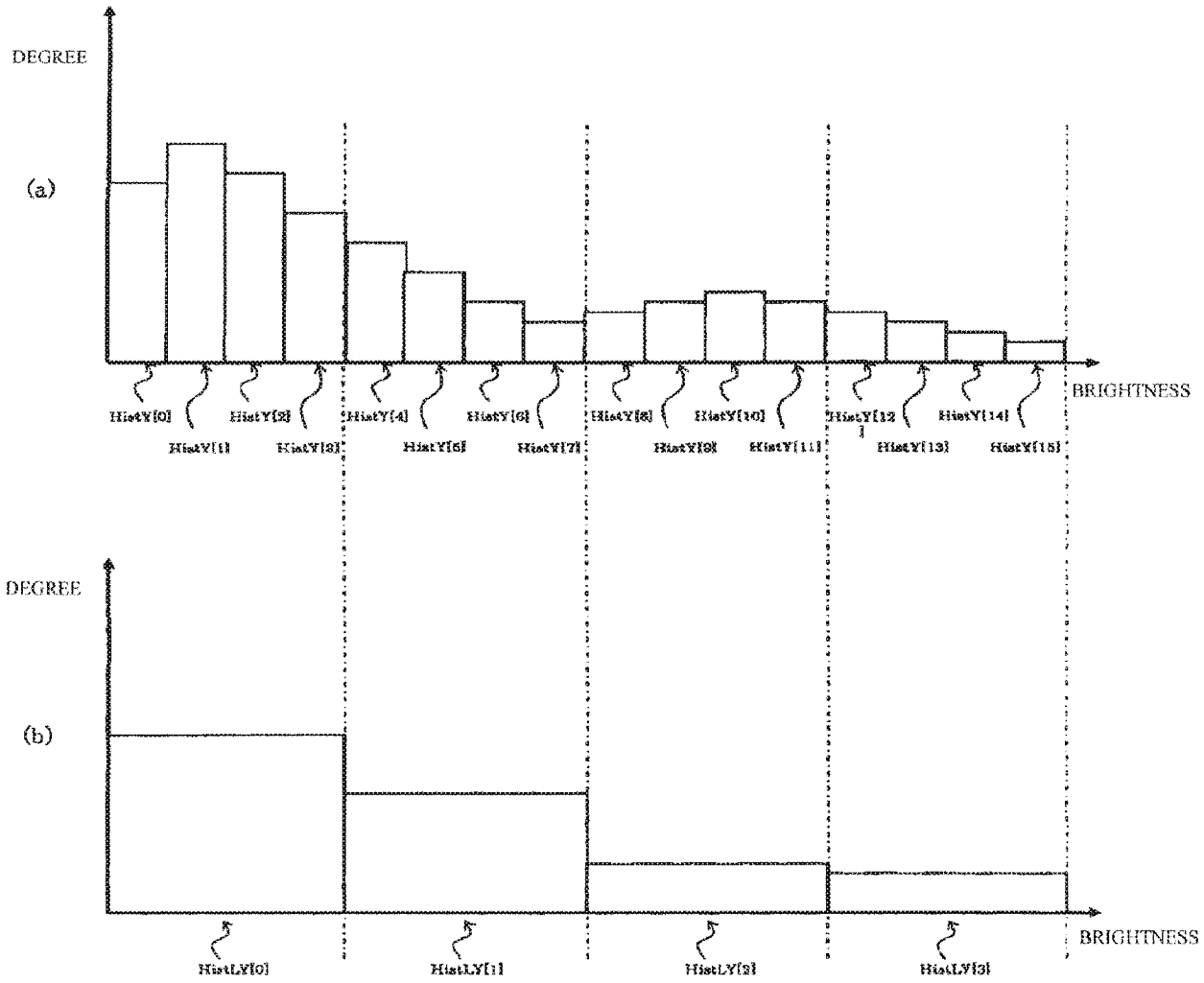
FIG. 5A is a diagram illustrating an example of a 16-stage histogram.
FIG. 5B is a diagram illustrating an example of a 4-stage histogram.

As examples, FIG. 5 illustrates a 16-stage histogram and a 4-stage histogram acquired for luminance signal Y. In FIG. 5, upper separation figure (a) illustrates the 16-stage histogram and lower separation figure illustrates the 4-stage histogram.

Further, histogram acquisition unit 102 includes four registers HistLR[0] to HistLR[3] for creating a 4-stage histogram regarding red signal R. Count values are added to HistLR[0] to HistLR[3] according to formulas (6) to (9) below. Accordingly, for red signal R, the 4-stage histogram can be calculated from the 16-stage histogram.

$$\mathrm{Hist}LR[0]=\mathrm{Hist}R[0]+\mathrm{Hist}R[1]+\mathrm{Hist}R[2]+\mathrm{Hist}R[3] \quad \text{Formula (6)}$$

$$\mathrm{Hist}LR[1]=\mathrm{Hist}R[4]+\mathrm{Hist}R[5]+\mathrm{Hist}R[6]+\mathrm{Hist}R[7] \quad \text{Formula (7)}$$

$$\mathrm{Hist}LR[2]=\mathrm{Hist}R[8]+\mathrm{Hist}R[9]+\mathrm{Hist}R[10]+\mathrm{Hist}R[11] \quad \text{Formula (8)}$$

$$\mathrm{Hist}LR[3]=\mathrm{Hist}R[12]+\mathrm{Hist}R[13]+\mathrm{Hist}R[14]+\mathrm{Hist}R[15] \quad \text{Formula (9)}$$

Further, histogram acquisition unit 102 includes four registers HistLG[0] to HistLG[3] for creating a 4-stage histogram regarding green signal G. Count values are added to HistLG[0] to HistLG[3] according to formulas (10) to (13) below. Accordingly, for green signal G, the 4-stage histogram can be calculated from the 16-stage histogram.

$$\mathrm{Hist}LG[0]=\mathrm{Hist}G[0]+\mathrm{Hist}G[1]+\mathrm{Hist}G[2]+\mathrm{Hist}G[3] \quad \text{Formula (10)}$$

$$\mathrm{Hist}LG[1]=\mathrm{Hist}G[4]+\mathrm{Hist}G[5]+\mathrm{Hist}G[6]+\mathrm{Hist}G[7] \quad \text{Formula (11)}$$

$$\mathrm{Hist}LG[2]=\mathrm{Hist}G[8]+\mathrm{Hist}G[9]+\mathrm{Hist}G[10]+\mathrm{Hist}G[11] \quad \text{Formula (12)}$$

$$\mathrm{Hist}LG[3]=\mathrm{Hist}G[12]+\mathrm{Hist}G[13]+\mathrm{Hist}G[14]+\mathrm{Hist}G[15] \quad \text{Formula (13)}$$

Further, histogram acquisition unit 102 includes four registers HistLB[0] to HistLB[3] for creating a 4-stage histogram regarding blue signal B. Count values are added to HistLB[0] to HistLB[3] according to formulas (14) to (17) below. Accordingly, for blue signal B, the 4-stage histogram can be calculated from the 16-stage histogram.

$$\mathrm{Hist}LB[0]=\mathrm{Hist}B[0]+\mathrm{Hist}B[1]+\mathrm{Hist}B[2]+\mathrm{Hist}B[3] \quad \text{Formula (14)}$$

$$\mathrm{Hist}LB[1]=\mathrm{Hist}B[4]+\mathrm{Hist}B[5]+\mathrm{Hist}B[6]+\mathrm{Hist}B[7] \quad \text{Formula (15)}$$

$$\mathrm{Hist}LB[2]=\mathrm{Hist}B[8]+\mathrm{Hist}B[9]+\mathrm{Hist}B[10]+\mathrm{Hist}B[11] \quad \text{Formula (16)}$$

$$\mathrm{Hist}LB[3]=\mathrm{Hist}B[12]+\mathrm{Hist}B[13]+\mathrm{Hist}B[14]+\mathrm{Hist}B[15] \quad \text{Formula (17)}$$

Histogram acquisition unit 102 supplies histogram signal S10 including the 16-stage histogram and the 4-stage histogram acquired for each of luminance signal Y, red signal R, green signal G, and blue signal B to analysis unit 103.

Analysis unit 103 determines whether to perform dimming control for light source 4 on the basis of the 4-stage histogram regarding each of luminance signal Y, red signal R, green signal G, and blue signal B.

Hereinafter, dimming control execution determination will specifically be described.

First, analysis unit 103 ranks stages for the 4-stage histogram regarding each of luminance signal Y, red signal R, green signal G, and blue signal B.

Specifically, analysis unit 103 ranks HistLY[0] to HistLY[3] of the 4-stage histogram regarding luminance signal Y as 1st, 2nd, 3rd, and 4th in descending order of degrees (histogram counts).

Taking the 4-stage histogram regarding luminance signal Y illustrated in separation figure (b) of FIG. 5 as an example, HistLY[0] to HistLY[3] are ranked as follows:

HistLY[0]: 1st
HistLY[1]: 2nd
HistLY[2]: 3rd
HistLY[3]: 4th

As in the case of luminance signal Y, analysis unit 103 ranks stages for the 4-stage histogram regarding each of red signal R, green signal G, and blue signal B on the basis of degrees (histogram counts).

Next, analysis unit 103 determines whether following conditions 1 to 4 are satisfied.

(Condition 1) the order of HistLY[0] among HistLY[0] to HistLY[3] is 1st.

(Condition 2) the order of HistLR[3] among HistLR[0] to HistLR[3] is not 1st.

(Condition 3) the order of HistLG[3] among HistLG[0] to HistLG[3] is not 1st.

(Condition 4) the order of HistLB[3] among HistLB[0] to HistLB[3] is not 1st.

When all above conditions 1 to 4 are satisfied, analysis unit 103 determines that dimming control will be performed. When any one of above conditions 1 to 4 is not satisfied, analysis unit 103 determines that dimming control will not be performed.

Analysis unit 103 supplies analysis signal S11 to dimming level calculation unit 104, and supplies dimming determination flag S12 to sudden brightness change detection unit 105. Analysis signal S11 includes a dimming control execution determination result and the 16-stage histogram regarding luminance signal Y. Dimming determination flag S12 is a signal indicating the dimming control execution determination result, and is set to "1" when dimming control is performed, and to '0" when dimming control is not performed.

Dimming level calculation unit 104 outputs, upon receiving the dimming control execution determination result indicating that dimming control is not performed from analysis unit 103, a dimming rate of 1.0 so that the output of light source 4 can be a maximum luminance output. Dimming level calculation unit 104 calculates, upon receiving the dimming control execution determination result indicating that dimming control is performed and the 16-stage histogram regarding luminance signal Y from analysis unit 103, a dimming rate by using the 16-stage histogram.

Hereinafter, a calculation procedure of a dimming rate will specifically be described.

First, dimming level calculation unit 104 calculates a dimming degree. The dimming degree is an index indicating the degree by which the brightness of light source 4 is darkened, and values thereof are given within the range of 0 to 1.0. The larger the value of the degree of dimming, the dark is Light source 4 while the smaller the value of the degree of dimming, the brighter is light source 4.

Dimming level calculation unit 104 calculates a dimming degree by using HistY[0], HistY[1], HistY[2], and HistY[3] of the 16-stage histogram regarding luminance signal Y. To calculate the dimming degree, dimming level calculation unit 104 performs optimization calculation for achieving a rate on the entire screen for each of HistY[0], HistY[1], HistY[2], and HistY[3]. Specifically, dimming level calculation unit 104 optimizes the rate by dividing a degree (histogram count) by the number of pixels on the entire screen for each of HistY[0], HistY[1], HistY[2], and HistY[3]. Thus, a maximum values among values that can be taken by each of HistY[0], HistY[1], HistY[2], and HistY[3] becomes 1. Dimming level calculation unit 104 has registers Hist[0], Hist[1], Hist[2], and Hist[3] for storing optimized values. In these registers Hist[0], Hist[1], Hist[2], and Hist[3], optimized values of respective HistY[0], HistY[1], HistY[2], and HistY[3] are stored.

For example, when display element 5 includes a screen having a resolution of a VGA (Video Graphics Array), and image data of 640×480 is input as RGB signal S1, dimming level calculation unit 104 performs optimization calculation according to formulas (18) to (21) below:

$$Hist[0]=HistY[0]\div(640\times480) \quad \text{Formula (18)}$$

$$Hist[1]=HistY[1]\div(640\times480) \quad \text{Formula (19)}$$

$$Hist[2]=HistY[2]\div(640\times480) \quad \text{Formula (20)}$$

$$Hist[3]=HistY[3]\div(640\times480) \quad \text{Formula (21)}$$

Then, dimming level calculation unit 104 calculates a dimming degree by using Hist[0] to Hist[3]. Specifically, in order to perform dimming in proportion to the ratio of dark pixels occupying the entire screen, dimming level calculation unit 104 calculates the dimming degree according to formula (22) below:

[Expression 1]

$$\text{Dimming degree} = Hist[0] + \left(\frac{Hist[1]}{2}\right) + \left(\frac{Hist[2]}{4}\right) + \left(\frac{Hist[3]}{8}\right) \quad \text{Formula (22)}$$

Then, dimming level calculation unit 104 calculates a dimming rate on the basis of the calculated dimming degree by formula (23) below:

$$\text{Dimming rate}=1.0-(\text{dimming degree}\times\text{maximum dimming gain}) \quad \text{Formula (23)}$$

When the dimming rate is 0, light source 4 is completely turned off. Normally, when light source 4 is completely turned off, problems may occur: for example, it takes time to stabilize the luminance of light source 4 when it is turned on again. Therefore, according to the present exemplary embodiment, the maximum dimming gain is set so as to prevent light source 4 from being turned off, in other words, to prevent the dimming rate from being set to 0.

Figure 6:
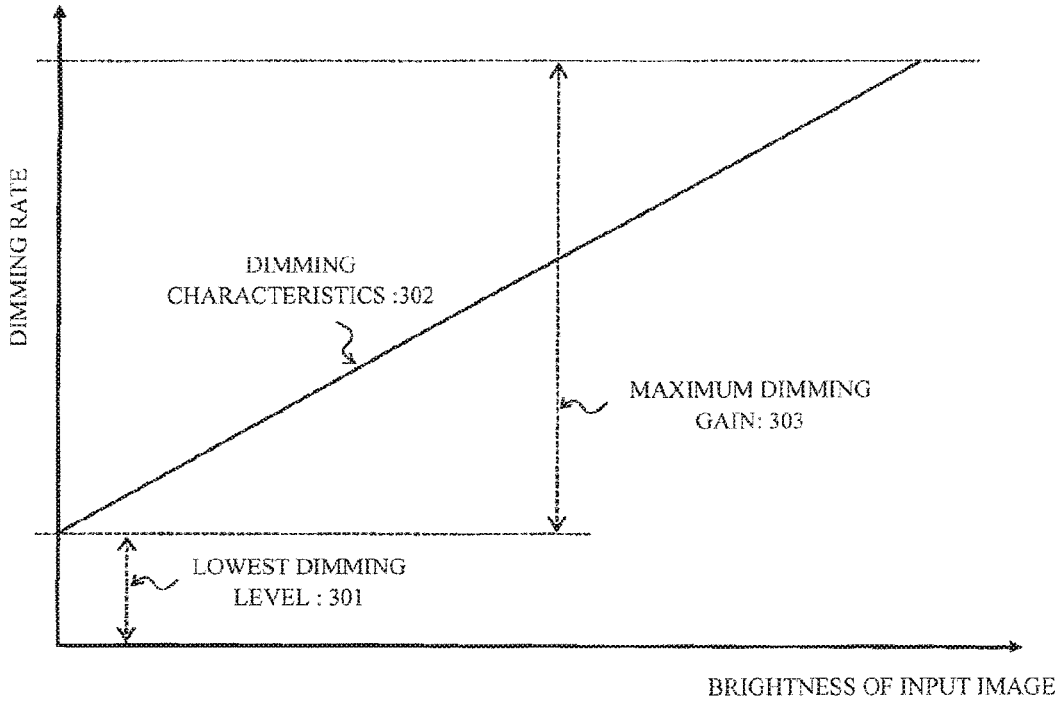
FIG. 6 is a characteristic diagram illustrating a relationship between brightness of an input image and a dimming rate.

FIG. 6 illustrates the relationship between brightness of an input image and the dimming rate. A horizontal axis indicates the brightness of the input image, specifically an image in which the number of darker pixels is larger toward the left. A vertical axis indicates a dimming rate. Specifically, the dimming light is lower toward the lower side to darken the light source, and conversely the dimming light is higher toward the upper side to brighten the light source.

Lowest dimming level 301 is set so as to prevent light source 4 from being turned off. Dimming characteristics 302 concern a straight line of a linear function changed from lowest dimming level 301 to a highest dimming level, indicating that the dimming rate is lower as the number of dark pixels included in the input image is larger, while the dimming rate is higher as the number of bright pixels is larger. A level range acquired by subtracting lowest dimming level 301 from the highest dimming level is maximum dimming gain 303. According to formula 23 above, light source 4 is not turned off because the dimming rate within maximum dimming gain 303 is used.

Dimming level calculation unit 104 supplies dimming signal S13 indicating the calculated dimming rate to sudden brightness change detection unit 105 and dimming reflection time adjustment unit 106.

Sudden brightness change detection unit 105 determines whether brightness of RGB signal S1 has suddenly changed on the basis of dimming determination flag S12 from analysis unit 103 and dimming signal S13 from dimming level calculation unit 104, and supplies sudden brightness change signal S14 indicating the determination result to dimming reflection time adjustment unit 106.

Sudden brightness change detection unit 105 determines, on the basis of dimming determination flag S12, whether a predetermined number of frames, in which the dimming control is not performed, are continuously provided, and determines, on the basis of dimming signal S13, whether a predetermined number of frames having dimming rates smaller than a threshold are continuously provided. Sudden brightness change detection unit 105 determines that the brightness of RGB signal S1 has suddenly changed only when a predetermined number of frames not subjected to dimming control are continuously provided after the predetermined number of frames having dimming rates smaller than the threshold have been continuously provided.

Figure 7:
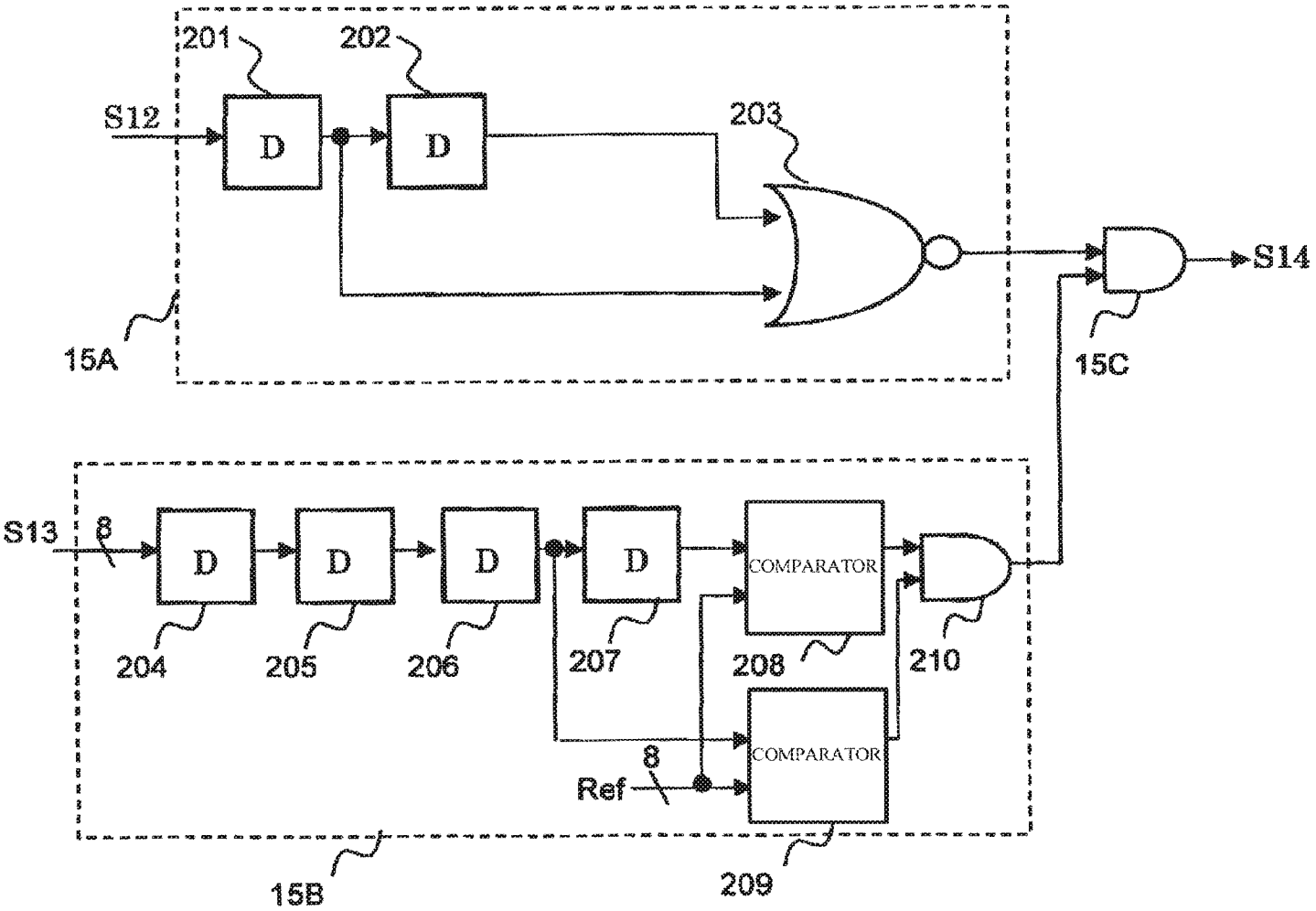
FIG. 7 is a circuit diagram illustrating an example of a sudden brightness change detection unit of the light source dimming unit illustrated in FIG. 4.

FIG. 7 is a circuit diagram illustrating an example of sudden brightness change detection unit 105. Referring to FIG. 7, sudden brightness change detection unit 105 has first determination unit 15A, second determination unit 15B, and AND gate 15C.

First determination unit 15A is a circuit that performs dimming determination on the basis of dimming determination flag S12, and includes D flip-flops 201, 202, and NOR gate 203. Dimming determination flag S12 is supplied to an input terminal of D flip-flop 201. An output terminal of D flip-flop 201 is connected to an input terminal of D flip-flop 202 and one input terminal of NOR gate 203. An output terminal of D flip-flop 202 is connected to the other input terminal of NOR gate 203. An output terminal of NOR gate 203 is connected to one input terminal of AND gate 15C.

In first determination unit 15A, for dimming determination flag S12, data of two temporally continuous frames is stored in D flip-flops 201, 202. For example, when a dimming determination result of an n-th frame is stored in D flip-flop 201, a dimming determination result of an (n−1)-th frame that is a last frame is stored in D flip-flop 202. From NOR gate 203, "1" is output only when both D flip-flops 201, 202 are "0", and "0" is output otherwise. In other words, the output from NOR gate 203 becomes "1" only when two or more frames having dimming determination flag S12 set to "0" are continuously provided. Accordingly, a period when dimming is not performed for two or more frames can be detected.

Second determination unit 15B is a circuit that performs threshold determination on the basis of dimming signal S13, and has D flip-flops 204 to 207, comparators 208, 209, and AND gate 210. Dimming signal S13 is supplied to an input terminal of D flip-flop 204. An output terminal of D flip-flop 204 is connected to an input terminal of D flip-flop 205, and an output terminal of D flip-flop 205 is connected to an input terminal of D flip-flop 206. An output terminal of D flip-flop 206 is connected to an input terminal of D flip-flop 207 and one input terminal of comparator 209.

An output terminal of D flip-flop 207 is connected to one input terminal of comparator 208. Reference signal Ref indicating a threshold is supplied to the other input terminals of respective comparators 208 and 209. An output terminal of comparator 208 is connected to one input terminal of AND gate 210, and an output terminal of comparator 209 is connected to the other input terminal of AND gate 210. An output terminal of AND gate 210 is connected to the other input terminal of ND gate 15C.

In second determination unit 15B, for dimming signal S13, data of four frames continuous in time is stored in D flip-flops 204 to 207. For example, when the dimming rate of an n-th frame is stored in D flip-flop 204, the dimming rate of an (n−1)-th frame that is a last frame is stored in D flip-flop 205. Further, the dimming rate of an (n−2)-th frame is stored in D flip-flop 206, and the dimming rate of an (n−3)-th frame is stored in D flip-flop 207. The (n−2)-th frame is a frame two before the n-th frame, and the (n−3)-th frame is a frame three before the n-th frame.

Comparator 208 outputs "1" only when the dimming rate stored in D flip-flop 207 is smaller than the threshold indicated by reference signal Ref, and otherwise outputs "0". Comparator 209 outputs "1" only when the dimming rate stored in D flip-flop 206 is smaller than the threshold indicated by reference signal Ref, and otherwise outputs "0". From AND gate 210, "1" is output when outputs of both comparators 208 and 209 become "1", and otherwise "0" is output. In other words, the output from AND gate 210 becomes "1" only when two or more frames, in which the dimming rates indicated by dimming signal S13 are smaller than the threshold, are continuously provided. Accordingly, for example, continuance of two frames or more of an image having a dimming rate smaller than the threshold value (e.g., image indicating black screen) can be detected. In other words, a period when the dimming rates of two or more frames are smaller than the threshold value can be detected.

From AND gate 15C, "1" is output only when both the output of first determination unit 15A (output of NOR gate 203) and the output of second determination unit 15B (output of NOR gate 210) become "1", and otherwise "0" is output. The output of AND gate 15C is the output (sudden brightness change signal S14) from sudden brightness change detection unit 105.

In sudden brightness change detection unit 105 illustrated in FIG. 7, the data storage operation of first determination unit 15A regarding dimming determination flag S12 and the data storage operation of second determination unit 15B regarding dimming signal S13 are linked with each other. For example, when the dimming determination result of the n-frame is stored in D flip-flop 201 of first determination unit 15A, the dimming rate of the n-th frame is stored in D flip-flop 204 of second determination unit 15B. According to this configuration, sudden brightness change signal S14 is set to "1" only when two or more frames, in which the dimming control is not performed, are continuously provided after two or more frames having a dimming rate smaller than the threshold have been continuously provided.

For example, when sudden brightness change detection unit 105 is set in the following state with respect to the series of frames a1 to a6 illustrated in FIG. 1, sudden brightness change signal S14 becomes "1".

Frames having dimming rates smaller than the threshold are frames a3, a4, and frames not subjected to dimming control are frames a5, a6. The threshold is set to a value (e.g., 15%) larger than the dimming rate "10%" of frames a3, a4. In first determination unit 15A, a dimming determination result of frame a6 is stored in D flip-flop 202, and a dimming determination result of frame a5 is stored in D flip-flop 201. At this time, in second determination unit 15B, the dimming rate of frame a4 is stored in D flip-flop 207, and the dimming rate of frame a3 is stored in D flip-flop 206. In this case, "1" is output from both NOR gate 203 of first determination unit 15A and AND gate 210 of second determination unit 15B and, as a result, the output of AND gate 15C, in other words, sudden brightness change signal S14, becomes "1".

Dimming reflection time adjustment unit 106 receives dimming signal S13 from dimming level calculation unit 104, and receives sudden brightness change signal S14 from sudden brightness change detection unit 105. Dimming reflection time adjustment unit 106 executes a dimming reflection time adjustment process on the basis of dimming signal S13 and sudden brightness change signal S14.

Figure 8:
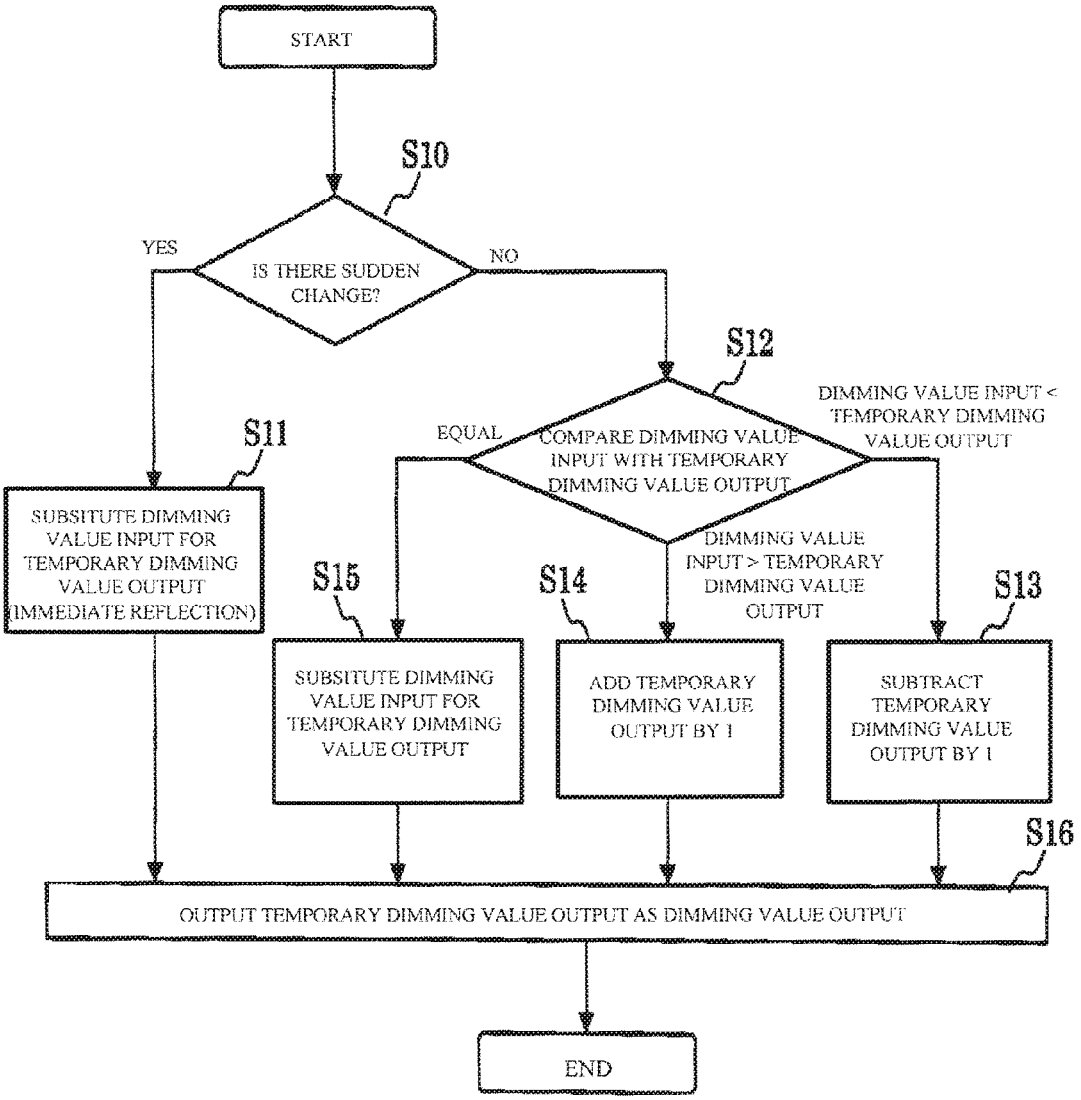
FIG. 8 is a flowchart illustrating a procedure of a dimming reflection time adjustment process.

FIG. 8 is a flowchart illustrating a procedure of the dimming reflection time adjustment process. Hereinafter, the dimming reflection time adjustment process will be described referring to FIG. 8.

Dimming reflection time adjustment unit 106 determines whether there is a sudden change on the basis of sudden brightness change signal S14 (step S10). Dimming reflection time adjustment unit 106 determines that there is a sudden change when sudden brightness change signal S14 is "1". Dimming reflection time adjustment unit 106 determines that there is no sudden change when sudden brightness change signal S14 is "0".

When a determination result in step S10 is "YES", dimming reflection time adjustment unit 106 directly substitutes a dimming rate (dimming value input) indicated by dimming signal S13 for a temporary dimming value output (step S11).

When the determination result in step S10 is "NO", dimming reflection time adjustment unit 106 compares the dimming rate (dimming value input) indicated by dimming signal S13 with the temporary dimming value output (step S12).

When a comparison result in step 12 is "dimming value input<temporary dimming value output", dimming reflection time adjustment unit 106 reduces the temporary dimming value output by "1 point" (step S13). For example, it means that when the temporary dimming value output is 10%, the temporary dimming value output is reduced to 9%. A reduction amount may be a predetermined value, not limited to 1 point, but may be, for example, 3 points. Any value may be used as long as an unnatural image change does not occur. When the comparison result in step 12 is "dimming value input>temporary dimming value output", dimming reflection time adjustment unit 106 increases the temporary dimming value output by "1 point" (step S14). Similarly, for example, it means that when the temporary dimming value output is 10%, the temporary dimming value output is increased to 11%. A reduction amount may be a predetermined value, not limited to 1 point, but may be, for example, 3 points. Any value may be used as long as an unnatural image change does not occur. When the comparison result in step 12 is "dimming value input=temporary dimming value output", dimming reflection time adjustment unit 106 substitutes the dimming value input for the temporary dimming value output (step S15).

When one of steps S11 and S13 to S15 is executed, dimming reflection time adjustment unit 106 then outputs the temporary dimming value output as a dimming value output (step S16). This dimming value output is dimming signal S2.

Display element driving unit 3 drives display element 5 according to RGB signal S3. Light source driving unit 2 increases/decreases driving power (driving current or driving voltage) supplied to light source 4 according to the dimming value output indicated by dimming signal S2. When the dimming value output is 1.0, the driving power becomes maximum to set light source 4 in a maximum luminance output state. When the dimming value output is reduced, the driving power is decreased to lower the luminance of light source 4. The change in luminance of light source 4 made according to the dimming value output is accompanied by a change in brightness of an image displayed by display element 5.

Next, a dimming control operation of the image display apparatus according to the present exemplary embodiment will be described.

Figure 1:
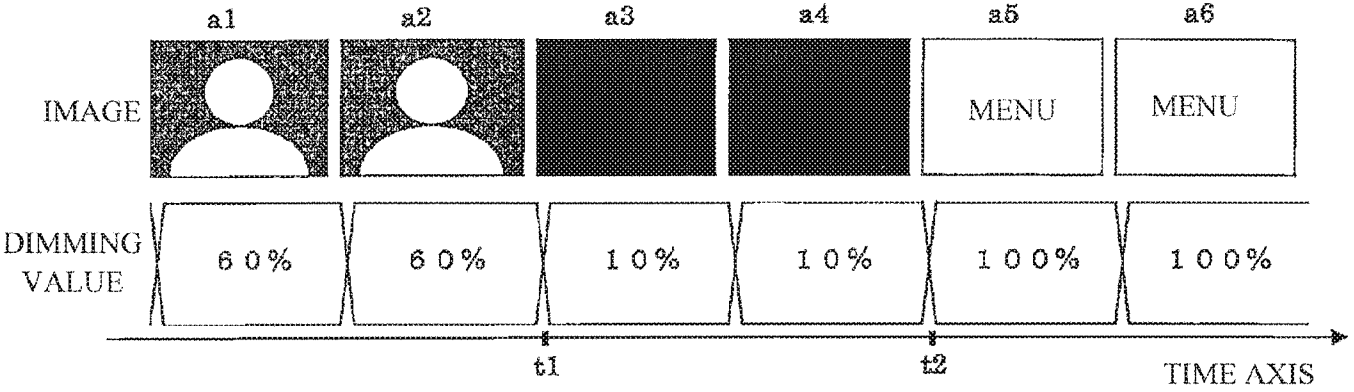
FIG. 1 is an explanatory diagram illustrating a series of frames and dimming values for the frames from a reproduction stop to displaying of a menu screen.
Figure 2:
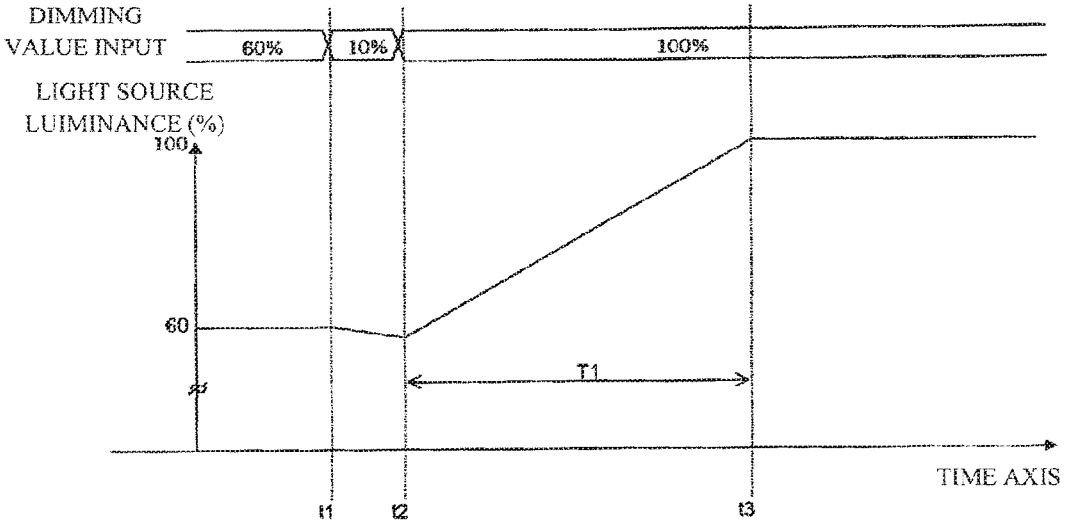
FIG. 2 is an explanatory diagram illustrating a dimming operation when the series of frames illustrated in FIG. 1 are displayed by the video display apparatus disclosed in Patent Literature 1.
Figure 9:
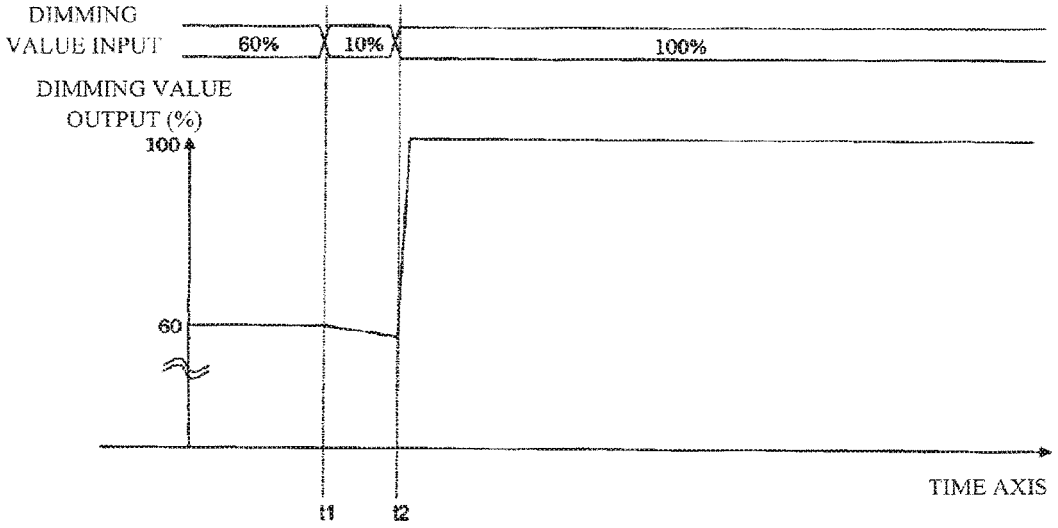
FIG. 9 is an explanatory diagram illustrating an example of a dimming control operation.

FIG. 9 illustrates an example of a dimming control operation when the series of frames illustrated in FIG. 1 are displayed. Here, it is assumed that a value of reference signal Ref serving as the threshold is set to "15%".

At time t1, RGB signal S1 is switched from an image of frame a2 to a black screen of frame a3. Then, at time t2, RGB signal S1 is switched from a black screen of frame a4 to a menu screen of frame a5. In the example illustrated in FIG. 9, at frame a6 after, frames of menu screens are input as RGB signal S1.

When RGB signal S1 is switched from the image of frame a2 to the black screen of frame a3 at time t1, dimming level calculation unit 104 outputs dimming signal S13 indicating "10%" that is the dimming rate of the black screen of frame a3. The black screen of frame a3 is an image subjected to dimming, and thus analysis unit 103 outputs dimming determination flag S12 indicating "1".

In sudden brightness change detection unit 105, "1" is stored in each of D flip-flops 201, 202 of first determination unit 15A. In D flip-flops 204, 205, 206, and 207 of second determination unit 15B, "10%", "60%", "60%", and "60%" are respectively stored. In this case, sudden brightness change detection unit 105 outputs sudden brightness change signal S14 indicating "0", and thus dimming reflection time adjustment unit 106 determines that there is no sudden change.

Dimming reflection time adjustment unit 106 compares the dimming rate "10%" indicated by dimming signal S13 with the temporary dimming value output. As the temporary dimming value output at time t1 is "60%", dimming reflection time adjustment unit 106 determines "dimming value input<temporary dimming value output". Then, dimming reflection time adjustment unit 106 outputs a value acquired by subtracting 1 point from the temporary dimming value output as a dimming value output.

When the screen is switched from the black screen of frame a3 to the black screen of frame a4, then dimming level calculation unit 104 outputs dimming signal S13 indicating "10%" that is the dimming rate of the black screen of frame a4. The black screen of frame a3 is an image subjected to dimming, and thus analysis unit 103 outputs dimming determination flag S12 indicating "1".

In sudden brightness change detection unit 105, "1" is stored in each of D flip-flops 201, 202 of first determination unit 15A. In D flip-flops 204, 205, 206, and 207 of second determination unit 15B, "10%", "10%", "60%", and "60%" are respectively stored. In this case, sudden brightness change detection unit 105 outputs sudden brightness change signal S14 indicating "0", and thus dimming reflection time adjustment unit 106 determines that there is no sudden change.

Since the dimming rate "10%" indicated by dimming signal S13 is smaller than the temporary dimming value output, dimming reflection time adjustment unit 106 determines "dimming value input<temporary dimming value output". Then, dimming reflection time adjustment unit 106 outputs a value acquired by subtracting 1 point from the temporary dimming value output as a dimming value output.

At time t2, when the screen is switched from the black screen of frame a4 to the menu screen of frame a5, then dimming level calculation unit 104 outputs dimming signal S13 indicating "100%" that is the dimming rate of the menu screen of frame a5. The menu screen of frame a5 is an image not subjected to dimming, and thus analysis unit 103 outputs dimming determination flag S12 indicating "1".

In sudden brightness change detection unit 105, "1" is stored in each of D flip-flops 201, 202 of first determination unit 15A. In D flip-flops 204, 205, 206, and 207 of second determination unit 15B, "10%", "10%", "10%", and "60%" are respectively stored. Also in this case, sudden brightness change detection unit 105 outputs sudden brightness change signal S14 indicating "0", and thus dimming reflection time adjustment unit 106 determines that there is no sudden change.

Dimming reflection time adjustment unit 106 compares a dimming rate "100%" indicated by dimming signal S13 with the temporary dimming value output. Since the temporary dimming value output at time t2 is smaller than "100%", dimming reflection time adjustment unit 106 determines "dimming value input>temporary dimming value output". Then, dimming reflection time adjustment unit 106 outputs a value acquired by adding 1 point to the temporary dimming value output as a dimming value output.

When the screen is switched from the menu screen of frame a5 to the menu screen of frame a6, then dimming level calculation unit 104 outputs dimming signal S13 indicating "100%" that is the dimming rate of the menu screen of frame a6. The menu screen of frame a6 is an image not subjected to dimming, and thus analysis unit 103 outputs dimming determination flag S12 indicating "0".

In sudden brightness change detection unit 105, "0" is stored in each of D flip-flops 201, 202 of first determination unit 15A. In D flip-flops 204, 205, 206, and 207 of second determination unit 15B, "100%", "100%", "10%", and "10%" are respectively stored. In this case, sudden brightness change detection unit 105 outputs sudden brightness change signal S14 indicating "1", and dimming reflection time adjustment unit 106 determines that there is a sudden change.

When it is determined that there is a sudden change, dimming reflection time adjustment unit 106 substitutes the dimming rate "100%" indicated by dimming signal S13 for the temporary dimming value output, and outputs a value of the temporary dimming value output directly as the dimming value output.

In light source dimming unit 1, through the delay process, the dimming value output of dimming reflection time adjustment unit 106 for the n-th frame of RGB signal S1 is used as a dimming value for the n-th frame of RGB signal S3. Thus, the display operation based on RGB signal S3 and the dimming control operation based on RGB signal S 1 illustrated in FIG. 9 are synchronized with each other.

According to the foregoing dimming control operation, when the screen is switched from an image such as a black screen having a dimming rate lower than the threshold to an image such as a menu screen not requiring dimming control, the luminance of the light source can be immediately set to "100%". Thus, the brightness of the image such as the menu screen that does not require dimming control can be prevented from becoming unnatural.

In the dimming control operation illustrated in FIG. 9, sudden brightness change detection unit 105 outputs sudden brightness change signal S14 indicating "1" when the frame that is not subjected to dimming control continues twice after the frame whose dimming rate is smaller than the threshold continues twice. Accordingly, exposure control is performed for the menu screen of frame a5 immediately after time t2. However, since the period of one frame is short, a change in brightness caused by the dimming control is not recognized by the viewer. Normally, during a period corresponding to five frames, even when dimming control is performed for the menu screen, the viewer does not recognize a luminance change, nor feel uncomfortable.

Further, in the image display apparatus according to the present exemplary embodiment, in order to detect a sudden change in brightness, first determination for determining whether to execute dimming control and second determination for detecting an image such as a black screen whose dimming rate is lower than the threshold are performed. Normally, regarding a moving image, when the light source is immediately set to a maximum luminance output for a frame that does not require dimming control, the screen may suddenly become bright thus causing the viewer to feel uncomfortable. It is difficult to solve such a problem only through the first determination. According to the present exemplary embodiment, by performing the second determination in addition to the first determination, the light source can be immediately set to the maximum luminance output only for an image such as a menu screen displayed under specific conditions.

The foregoing image display apparatus according to the present exemplary embodiment is an example of the present invention, and the configuration and the operations thereof can be appropriately changed.

For example, in sudden brightness change detection unit 105 illustrated in FIG. 7, first determination unit 15A is configured to detect the state where the frame that is not subjected to dimming control continues twice or more, but is not limited to this form. The number of detected frames that are not subjected to dimming control may be at least 3 or 1. However, the number of D flip-flops increases/decreases according to the number of detected frames that are not subjected to dimming control.

For example, when the number of detected frames that are not subjected to dimming control is one, a configuration includes D flip-flop 202 and NOR gate 203. The output of D flip-flop 202 is supplied to one input of NOR gate 203, and "0" is always supplied to the other input. From NOR gate 203, "1" is output only when "0" is stored in D flip-flop 202, and otherwise "0" is output. According to this configuration, in the dimming control operation illustrated in FIG. 9, at time t2, when the screen is switched from the black screen of frame a4 to the menu screen of frame a5, sudden brightness change detection unit 105 then outputs sudden brightness change signal S14 indicating "1". Accordingly, dimming control is not performed for the menu screen of frame a5.

When the number of detected frames that are not subjected to dimming control is three, a configuration includes three serially connected D flip-flops. In this case, from the NOR gate, "1" is output only when "0" is stored in all the D flip-flops, and otherwise "0" is output. When the number of detected frames that are not subjected to dimming control increases, the number of stages for the D flip-flop increases, thus increasing cost. In addition, in the dimming control operation illustrated in FIG. 9, the period of performing the dimming control after time t2 becomes longer.

In sudden brightness change detection unit 105 illustrated in FIG. 7, second determination unit 15B is configured to detect the state where the frame whose dimming rate is smaller than the threshold continues twice, but is not limited to this form. The number of detected frames whose dimming rates are smaller than the threshold may be at least 3 or 1. However, the number of D flip-flops increases/decreases according to the number of detected frames whose dimming rates are smaller than the threshold.

For example, when the number of detected frames whose dimming rates are smaller than the threshold is one, the configuration includes D flip-flop 205 to 207, comparator 208, and AND gate 210. The output of comparator 208 is supplied to one input of AND gate 210, and "1" is always supplied to the other input. From AND gate 210, "1" is output when the output of comparator 208 is "1", and otherwise "0" is output.

When the number of detected frames having dimming rates smaller than the threshold is three, in the configuration illustrated in FIG. 7, one D flip-flop is inserted into an input side of D flip-flop 204. In addition, a third comparator to which the output of D flip-flop 205 and reference signal Ref are input is provided. The third comparator outputs "1" only when the dimming rate stored in D flip-flop 205 is smaller than the threshold indicated by reference signal Ref, and otherwise outputs "0". From AND gate 210, "1" is output only when "1" is stored in all of D flip-flop 205, comparators 208, 209, and the third compactor, and otherwise "0" is output.

When the number of detected frames having dimming rates smaller than the threshold is m (≥2) and the number of detected frames that are not subjected to dimming control is n (n≥2) sudden brightness change detection unit 105 may be configured in a manner described below.

First determination unit 15A includes n serially connected first D flip-flops, and a NOR gate to which an output of each first D flip-flop is input and from which 1 is output only when all inputs are "0", and otherwise "0" is output. The n first D flip-flops time-sequentially store dimming determination flag S12 by n frames.

Second determination unit 15B includes (n+m) serially connected second D flip-flops, m comparators, and an AND gate. The (n+m) second D flip-flops time-sequentially store dimming signal S13 by (n+m) frames.

To the m comparators, outputs of m second D flip-fops on the output stage side from among the (n+m) second D flip-flops are input on one hand, and the threshold is input on the other hand. Each comparator outputs "1" only when the input on the one hand is smaller than the threshold, and otherwise outputs "0". From the AND gate, to which an output of each comparator is input, "1" is output only when all the inputs are "1", and otherwise "0" is output.

In the above configuration, m and n may be equal in value, or m and n may be different in value.

In addition, in light source dimming unit 1 illustrated in FIG. 3, components (signal gain multiplication rate calculation unit and signal gain multiplication circuit) that amplify an amplitude of RGB signal S3 according to dimming signal S2 (dimming value output) from dimming reflection time adjustment unit 106 may be added.

The signal gain multiplication rate calculation unit calculates a multiplication rate by formula (24) below on the basis of a dimming value indicated by dimming signal S2:

$$\text{Multiplication rate}=1.0\div\text{dimming rate} \qquad \text{Formula (24)}$$

RGB signal S1 has been supplied to the signal gain multiplication circuit. The signal gain multiplication circuit amplifies an amplitude of RGB signal S1 according to the multiplication rate from the signal gain multiplication rate calculation unit. Specifically, the signal gain multiplication circuit multiplies red signal R, green signal G, and blue signal B input as RGB signal S1 by the multiplication rate indicated by a multiplication rate signal according to formulas (25) to (27) below. Then, the signal gain multiplication circuit outputs RGB signal S3 including red signal R, green signal G, and blue signal R multiplied by the multiplication rate.

$$R\ \text{output}=R\ \text{input}\times\text{multiplication rate} \qquad \text{Formula (25)}$$

$$G\ \text{output}=G\ \text{input}\times\text{multiplication rate} \qquad \text{Formula (26)}$$

$$B\ \text{output}=B\ \text{input}\times\text{multiplication rate} \qquad \text{Formula (27)}$$

Display element driving unit 3 drives display element 5 according to RGB signal S3. Red signal R, green signal G, and blue signal B of RGB signal S3 increase/decrease in amplitude according to the multiplication rate, and thus the brightness of the image displayed by display element 5 changes according to the multiplication rate.

By amplifying the amplitude of RGB signal S3 according to the multiplication rate as described above, a reduction in the brightness of a half-tone caused by darker light source 4 can be prevented. Thus, good reproduction of a black color and maintenance of brightness of the half-tone can be simultaneously achieved.

In the present exemplary embodiment, the 16-stage histogram and the 4-stage histogram are acquired for each of luminance signal Y, red signal R, green signal G, and blue signal B, but this form is in no way limitative. The 16-stage histogram and the 4-stage histogram may be acquired only for luminance signal Y, and the 4-stage histogram may be directly acquired from the image data for red signal R, green signal G, and blue signal B.

Second Exemplary Embodiment

An image display apparatus according to a second exemplary embodiment of the present invention, which has components similar to those illustrated in FIG. 3 and FIG. 4, is different from the first exemplary embodiment in that dimming control is performed by using an 8-stage histogram and a 4-stage histogram. Hereinafter, description will focus on components different from those of the first exemplary embodiment while omitting similar components.

Histogram acquisition unit 102 calculates luminance signal Y from RGB signal S1 according to aforementioned formula (1), and acquires an 8-stage histogram and a 4-stage histogram for each of luminance signal Y, red signal R, green signal G, and blue signal B. These histograms are acquired by one frame unit.

Hereinafter, an acquisition procedure of the 8-stage histogram when RGB signal S1 is 8-bit digital data will be described.

Histogram acquisition unit 102 includes eight registers HistY[0] to HistY[7] for creating an 8-stage histogram regarding luminance signal Y. These registers HistY[0] to HistY[7] are configured to be reset to 0 at the start time of a frame and store count values at the end time of the frame. Under addition conditions shown in Table 2 below, a count value of a corresponding register among HistY[0] to HistY[7] is added according to input data of luminance signal Y. Accordingly, the 8-stage histogram regarding luminance signal Y can be acquired.

TABLE 2

| NO | Input data | Register to be added |
|---|---|---|
| 0 | 32 > Y ≥ 0 | HistY[0] |
| 1 | 64 > Y ≥ 32 | HistY[1] |
| 2 | 96 > Y ≥ 64 | HistY[2] |
| 3 | 128 > Y ≥ 96 | HistY[3] |
| 4 | 160 > Y ≥ 128 | HistY[4] |
| 5 | 192 > Y ≥ 160 | HistY[5] |
| 6 | 224 > Y ≥ 192 | HistY[6] |
| 7 | 256 > Y ≥ 224 | HistY[7] |

Histogram acquisition unit 102 includes registers HistR[0] to HistR[7] for red signal R, registers HistG[0] to HistG[7] for green signal G, and registers HistB[0] to HistB[7] for blue signal B. These registers HistR[0] to HistR[7], HistG[0] to HistG[7], and HistB[0] to HistB[7] are also configured to be reset to 0 at the start time of a frame and store count values at the end time of the frame.

Addition conditions of red signal R are, in Table 2, conditions where the registers to be added, namely HistY[0] to HistY[7], are replaced with HistR[0] to HistR[7]. Under theses addition conditions, a count value of a corresponding register among HistR[0] to HistR[7] is added according to input data of red signal R. Accordingly, an 8-stage histogram regarding red signal R can be acquired.

Addition conditions of green signal G are, in Table 2, conditions where the registers to be added, namely HistY[0] to HistY[7], are replaced with HistG[0] to HistG[7]. Under theses addition conditions, a count value of a corresponding register among HistG[0] to HistG[7] is added according to input data of green signal G. Accordingly, an 8-stage histogram regarding green signal G can be acquired.

Addition conditions of blue signal B are, in Table 2, conditions where the registers to be added, namely HistY[0] to HistY[7], are replaced with HistB[0] to HistB[7]. Under theses addition conditions, a count value of a corresponding register among HistB[0] to HistB[7] is added according to input data of blue signal B. Accordingly, an 8-stage histogram regarding blue signal B can be acquired.

In addition, histogram acquisition unit 102 includes four registers HistLY[0] to HistLY[3] for creating a 4-stage histogram regarding luminance signal Y. Count values are added to HistLY[0] to HistLY[3] according to formulas (28) to (31) below. Accordingly, for luminance signal Y, the 4-stage histogram can be calculated from the 8-stage histogram.

$$\mathrm{Hist}LY[0]=\mathrm{Hist}Y[0]+\mathrm{Hist}Y[1] \quad \text{Formula (28)}$$

$$\mathrm{Hist}LY[1]=\mathrm{Hist}Y[2]+\mathrm{Hist}Y[3] \quad \text{Formula (29)}$$

$$\mathrm{Hist}LY[2]=\mathrm{Hist}Y[4]+\mathrm{Hist}Y[5] \quad \text{Formula (30)}$$

$$\mathrm{Hist}LY[3]=\mathrm{Hist}Y[6]+\mathrm{Hist}Y[7] \quad \text{Formula (31)}$$

Figure 10:
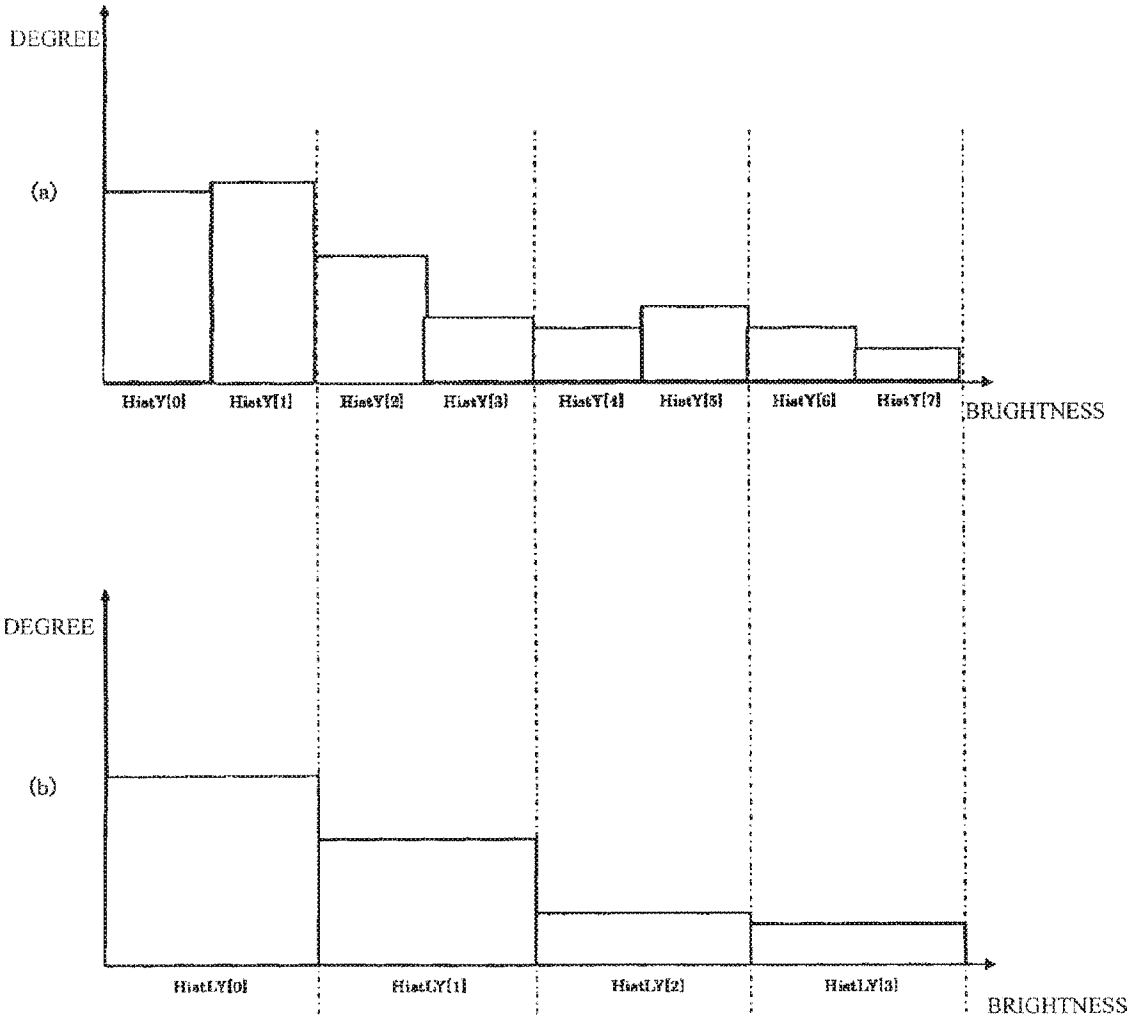
FIG. 10A is a diagram illustrating an example of an 8-stage histogram.
FIG. 10B is a diagram illustrating an example of a 4-stage histogram.

As examples, FIG. 10 illustrates an 8-stage histogram and a 4-stage histogram acquired for luminance signal Y. In FIG. 10, upper separation figure (a) illustrates the 8-stage histogram, and lower separation figure (b) illustrates the 4-stage histogram.

Further, histogram acquisition unit 102 includes four registers HistLR[0] to HistLR[3] for creating a 4-stage histogram regarding red signal R. Count values are added to HistLR[0] to HistLR[3] according to formulas (32) to (35) below. Accordingly, for red signal R, the 4-stage histogram can be calculated from the 8-stage histogram.

$$\mathrm{Hist}LR[0]=\mathrm{Hist}R[0]+\mathrm{Hist}R[1] \quad \text{Formula (32)}$$

$$\mathrm{Hist}LR[1]=\mathrm{Hist}R[2]+\mathrm{Hist}R[3] \quad \text{Formula (33)}$$

$$\mathrm{Hist}LR[2]=\mathrm{Hist}R[4]+\mathrm{Hist}R[5] \quad \text{Formula (34)}$$

$$\mathrm{Hist}LR[3]=\mathrm{Hist}R[6]+\mathrm{Hist}R[7] \quad \text{Formula (35)}$$

Further, histogram acquisition unit 102 includes four registers HistLG[0] to HistLG[3] for creating a 4-stage histogram regarding green signal G. Count values are added to HistLG[0] to HistLG[3] according to formulas (36) to (39) below. Accordingly, for green signal G, the 4-stage histogram can be calculated from the 8-stage histogram.

$$\mathrm{Hist}LG[0]=\mathrm{Hist}G[0]+\mathrm{Hist}G[1] \quad \text{Formula (36)}$$

$$\mathrm{Hist}LG[1]=\mathrm{Hist}G[2]+\mathrm{Hist}G[3] \quad \text{Formula (37)}$$

$$\mathrm{Hist}LG[2]=\mathrm{Hist}G[4]+\mathrm{Hist}G[5] \quad \text{Formula (38)}$$

$$\mathrm{Hist}LG[3]=\mathrm{Hist}G[6]+\mathrm{Hist}G[7] \quad \text{Formula (39)}$$

Further, histogram acquisition unit 102 includes four registers HistLB[0] to HistLB[3] for creating a 4-stage histogram regarding blue signal B. Count values are added to HistLB[0] to HistLB[3] according to formulas (40) to (43) below. Accordingly, for blue signal B, the 4-stage histogram can be calculated from the 8-stage histogram.

$$\mathrm{Hist}LB[0]=\mathrm{Hist}B[0]+\mathrm{Hist}B[1] \quad \text{Formula (40)}$$

$$\mathrm{Hist}LB[1]=\mathrm{Hist}B[2]+\mathrm{Hist}B[3] \quad \text{Formula (41)}$$

$$\mathrm{Hist}LB[2]=\mathrm{Hist}B[4]+\mathrm{Hist}B[5] \quad \text{Formula (42)}$$

$$\mathrm{Hist}LB[3]=\mathrm{Hist}B[6]+\mathrm{Hist}B[7] \quad \text{Formula (43)}$$

Histogram acquisition unit 102 supplies to analysis unit 103 the 8-stage histogram and the 4-stage histogram acquired for each of luminance signal Y, red signal R, green signal G, and blue signal B.

Analysis unit 103 ranks stages for the 4-stage histogram regarding each of luminance signal Y, red signal R, green signal G, and blue signal B on the basis of degrees (histogram counts). Taking the 4-stage histogram regarding luminance signal Y illustrated in separation figure (b) of FIG. 10 as an example, HistLY[0] to HistLY[3] are ranked as follows:

HistLY[0]: 1st
HistLY[1]: 2nd
HistLY[2]: 3rd
HistLY[3]: 4th

Analysis unit 103 determines whether to perform dimming control for light source 4 on the basis of aforementioned conditions 1 to 4. As in the case of the first exemplary embodiment, when all conditions 1 to 4 are satisfied, analysis unit 103 determines that dimming control will be performed. When any one of above conditions 1 to 4 is not satisfied, analysis unit 103 determines that dimming control will not be performed.

Analysis unit 103 supplies dimming determination flag S12, that indicates a dimming control execution determination result, to sudden brightness change detection unit 105, and supplies analysis signal S11, that includes the 8-stage histogram regarding luminance signal Y, to dimming level calculation unit 104.

Dimming level calculation unit 104 calculates, upon receiving the 8-stage histogram regarding luminance signal Y from analysis unit 103, a dimming rate by using the 8-stage histogram.

To calculate the dimming degree, dimming level calculation unit 104 first calculates a dimming degree by using HistY[0] and HistY[1] of the 8-stage histogram. Dimming level calculation unit 104 includes registers Hist[0] and Hist[1]. In these registers Hist[0] and Hist[1], optimized values of respective HistY[0] and HistY[1] are stored. For example, when display element 5 includes a screen having a resolution of a VGA (Video Graphics Array), and image data of 640×480 is input as RGB signal S1, dimming level calculation unit 104 performs optimization calculation according to formulas (44) to (45) below:

$$\mathrm{Hist}[0]=\mathrm{Hist}Y[0]\div(640\times480) \quad \text{Formula (44)}$$

$$\mathrm{Hist}[1]=\mathrm{Hist}Y[1]\div(640\times480) \quad \text{Formula (45)}$$

After the optimization calculation has been performed, dimming level calculation unit 104 calculates a dimming degree by formula (46) below using Hist[0] and Hist[2].

[Expression 2]

$$\text{Dimming degree} = \text{Hist}[0] + \left(\frac{\text{Hist}[1]}{2}\right) \quad \text{Formula (46)}$$

Then, dimming level calculation unit 104 calculates a dimming rate on the basis of the calculated dimming degree by aforementioned formula (23). Then, dimming level calculation unit 104 supplies dimming signal S13, that indicates the calculated dimming rate, to dimming reflection time adjustment unit 106.

The operations of sudden brightness change detection unit 105 and dimming reflection time adjustment unit 106 are similar to those of the first exemplary embodiment, and thus description thereof is omitted. The image display apparatus according to the present exemplary embodiment provides the same operation effects as those of the first exemplary embodiment. In the present exemplary embodiment, modification similar to that of the first exemplary embodiment is allowed.

The present invention is not limited to the configuration and the operations described above in the first or second exemplary embodiment, but changes can appropriately be made to the configuration and the operations without departing from the sprit and scope of the invention.

For example, the number of histogram stages is not limited to 16, 8, or 4. In place of the 16-stage or 8-stage histogram, a detailed histogram having a number of stages other than 16 or 8 may be used. In place of the 4-stage histogram, a rough histogram having a number of stages other than 4 may be used. However, when the number of stages is changed, the register configuration, the addition conditions of Tables 1 and 2, and the calculation formula of the dimming degree for creating the histogram are appropriately changed according to the number of stages.

For example, it is assumed that the stages of brightness of a detailed histogram regarding luminance signal Y are represented by HistY[0] to HistY[m] (m is natural number of 1 or more), and values acquired by dividing degrees of HistY[0] to HistY[m] by the number of pixels of display element 5 are represented by Hist[0] to Hist[m]. In this case, a dimming degree may be calculated by formula (47) below:

[Expression 3]

$$\text{Dimming degree} = \text{Hist}[0] + \sum_{k=1}^{n} \frac{\text{Hist}[k]}{2^k} \quad \text{Formula (47)}$$

A rough histogram may be created by collecting stages of brightness for each predetermined number of stages from a lower side of brightness of the detailed histogram. When the number of stages for the detailed histogram is not divisible by the number of stages of the rough histogram, in the detailed histogram, the number of stages to be collected on the lower side of brightness may be set larger than that to be collected on the other portion. Thus, the calculation accuracy of the dimming degree can be improved.

Figure 11:
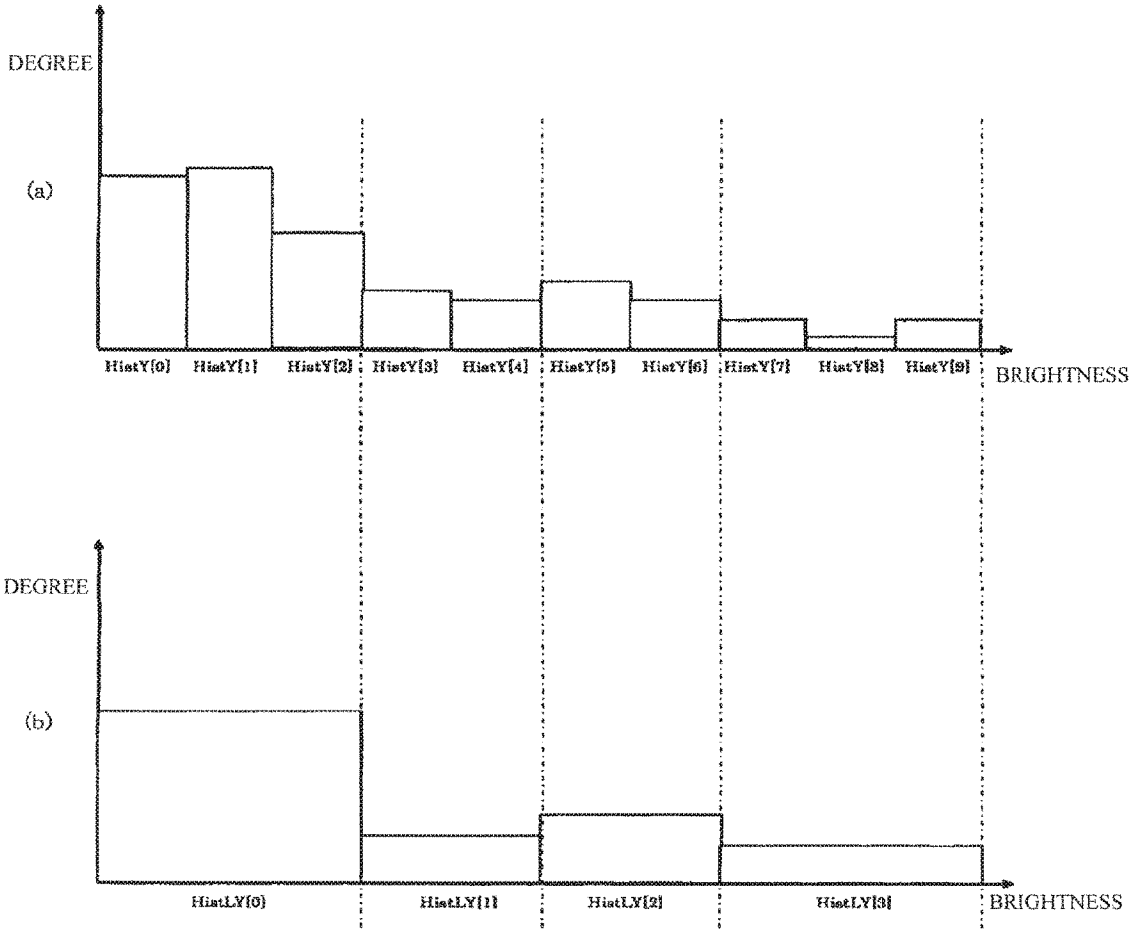
FIG. 11A is a diagram illustrating an example of a 10-stage histogram.
FIG. 11B is a diagram illustrating an example of a 4-stage histogram.

As examples, FIG. 11 illustrates a 10-stage histogram and a 4-stage histogram acquired for luminance signal Y. In FIG. 11, upper separation figure (a) illustrates the 10-stage histogram, and lower separation figure (b) illustrates the 4-stage histogram. The 10-stage histogram includes HistY[0] to HistY[9], and the 4-stage histogram includes HistY[0] to HistY[3]. HistY[0] represents an addition value of three HistY[0] to HistY[2]. HistY[1] represents an addition value of two HistY[3] and HistY[4]. HistY[2] represents an addition value of two HistY[5] and HistY[6]. HistY[3] represents an addition value of three HistY[7] to HistY[9].

The present invention can be applied to an image display apparatus or a projector represented by a liquid crystal display or the like. When the present invention is applied to the projector, as display element 5, a digital micro-mirror device (DMD) or a liquid display element is used. An image formed on display element 5 is projected onto a screen by a projection lens. As light source 4, a light source using a phosphor can be applied in addition to a solid light source such as a mercury lamp or a LED.

The present invention can take the forms described in following Supplementary Notes 1 to 7, but is not limited to these forms.

[Supplementary Note 1]

An image display apparatus which is provided with: a light source; and a display unit that spatially modulates a light from the light source on the basis of an input video signal to form an image, and which performs dimming control for adjusting luminance of the light source in stages, the image display apparatus comprising:

a light source dimming unit that determines whether to perform dimming control on the basis of the input video signal, acquires a dimming rate which is a ratio of brightness of an input image to a maximum luminance output from the light source, and sets an output of the light source to the maximum luminance output when a dimming rate of a frame immediately before a frame determined not to be subjected to dimming control is lower than a threshold.

[Supplementary Note 2]

The image display apparatus described in Supplementary Note 1, wherein the light source dimming unit includes:

a dimming rate calculation unit that acquires a luminance distribution of an image indicated by image data for each frame, determines whether to perform the dimming control on the basis of the luminance distribution to output a determination flag that indicates a result of the determination, and acquires the dimming rate which is a ratio of brightness of the image to the maximum luminance output of the light source to output a dimming signal that indicates the dimming rate;

a sudden brightness change detection unit that determines whether the dimming rate indicated by the dimming signal is lower than the threshold, detects, on the basis of the determination result and the determination flag, a state where a frame determined not to be subjected to the dimming control follows immediately after a frame whose dimming rate is determined to be lower than the threshold, and outputs a sudden brightness change signal that indicates presence of detection of the state; and a luminance setting unit that adjusts the luminance of the light source in stages on the basis of the dimming signal, and sets the output of the light source to the maximum luminance output when the sudden brightness change signal indicating that the state has been detected is received from the sudden brightness change detection unit.

[Supplementary Note 3]

The image display apparatus described in Supplementary Note 2, wherein the luminance setting unit stores a luminance set value of the light source, compares the dimming rate indicated by the dimming signal with the luminance set value for each frame, increases the luminance set value by a predetermined value when the dimming rate is larger than the luminance set value, decreases the luminance set value by a predetermined value when the dimming rate is smaller than the luminance set value, and sets the luminance set value to a value of the maximum luminance output when the sudden brightness change signal indicating that the state has been detected is received from the sudden brightness change detection unit.

[Supplementary Note 4]

The image display apparatus described in Supplementary Note 2 or 3, wherein the sudden brightness change detection unit includes:

n first D flip-flops that are connected in series and that time sequentially store the determination flag by n (≥2) frames;

a NOR gate to which outputs of the plurality of first D flip-flops are input and from which 1 is output only when all the inputs are 0 and otherwise 0 is output;

(n+m) second D flip-flops that are connected in series and that time sequentially store the dimming signal by (n+m (≥2)) frames;

m comparators which are provided for m second D flip-flops on an output stage side among the (n+m) second D flip-flops, each comparator, to which an output of a corresponding second D flip-flop is supplied as one input and the threshold is supplied as another input, outputting 1 only when the one input is smaller than the threshold and otherwise outputting 0;

a first AND gate to which outputs of the m comparators are input, and from which 1 is output only when all the inputs are 1 and otherwise 0 is output; and a second AND gate to which outputs of the NOR gate and the first AND gate are input, and from which 1 is output only when all the inputs are 1 and otherwise 0 is output.

[Supplementary Note 5]

The image display apparatus described in any one of Supplementary Notes 2 to 4, wherein the dimming rate calculation unit includes:

a histogram acquisition unit that acquires a first histogram that indicates the image data by degrees of each brightness stage for each frame on the basis of the input video signal, and a second histogram having the number of brightness stages that are different from the number of brightness stages of the first histogram;

an analysis unit that determines whether to perform the dimming control on the basis of the second histogram, and outputs a result of the determination as the determination flag; and a dimming level calculation unit that acquires the dimming rate on the basis of the first histogram, and outputs a signal that indicates the dimming rate as the dimming signal.

[Supplementary Note 6]

The image display apparatus described in Supplementary Note 5, wherein the number of brightness stages for the second histogram is smaller than that of the first histogram.

[Supplementary Note 7]

A method for dimming a light source for an image display apparatus which is provided with: the light source; and a display unit that spatially modulates a light from the light source on the basis of an input video signal to form an image, and which performs dimming control for adjusting luminance of the light source in stages, the method comprising:

determining whether to perform dimming control on the basis of the input video signal;

acquiring a dimming rate which is a ratio of brightness of an input image to a maximum luminance output from the light source; and setting an output of the light source to the maximum luminance output when a dimming rate of a frame immediately before a frame determined not to be subjected to dimming control is lower than a threshold.

In the image display apparatus described in above Supplementary Notes 1 to 6, the light source may include light source driving unit 2 and light source 4 illustrated in FIG. 3. The display unit may include display element driving unit 103 and display element 5 illustrated in FIG. 3. The light source dimming unit may include light source dimming unit 1 illustrated in FIG. 3. The dimming rate calculation unit, the sudden brightness change detection unit, and the luminance setting unit may respectively include dimming rate calculation unit 101, sudden brightness change detection unit 105, and dimming reflection time adjustment unit 106 illustrated in FIG. 4. The histogram acquisition unit, the analysis unit, and the dimming level calculation unit may respectively include histogram acquisition unit 102, analysis unit 103, and dimming level calculation unit 104 illustrated in FIG. 4.

REFERENCE SIGNS LIST

1 Light source dimming unit
2 Light source driving unit
3 Display element driving unit
4 Light source
5 Display element
102 Histogram acquisition unit
103 Analysis unit
104 Dimming level calculation unit
105 Sudden brightness change detection unit
106 Dimming reflection time adjustment unit

The invention claimed is:

1. An image display apparatus which includes: a light source; and a display unit that spatially modulates a light from the light source on a basis of an input video signal to form an image, and which performs dimming control for adjusting luminance of the light source in stages, the image display apparatus comprising:

a light source dimming unit that determines whether to perform dimming control on the basis of the input video signal, acquires a dimming rate which is a ratio of brightness of an input image to a maximum luminance output of the light source and maximizes the luminance of the light source when a dimming rate of a frame immediately before a frame determined not to be subjected to dimming control is lower than a threshold, wherein the light source dimming unit includes:

a dimming rate calculation unit that acquires a luminance distribution of an image indicated by image data for each frame, determines whether to perform the dimming control on the basis of the luminance distribution to output a determination flag that indicates a result of the determination, and acquires the dimming rate which is a ratio of brightness of the image to the maximum luminance output of the light source to output a dimming signal that indicates the dimming rate;

a sudden brightness change detection unit that determines whether the dimming rate indicated by the dimming signal is lower than the threshold, detects, on the basis of the determination result and the determination flag, a state where a frame determined not to be subjected to the dimming control follows immediately after a frame whose dimming rate is determined to be lower than the threshold, and outputs a sudden brightness change signal that indicates presence of detection of the state; and a luminance setting unit that adjusts the luminance of the light source in stages on the basis of the dimming signal, and sets an output of the light source to the maximum luminance output when the sudden brightness change signal indicating that the state has been detected is received from the sudden brightness change detection unit.

2. The image display apparatus according to claim 1, wherein the luminance setting unit stores a luminance set value of the light source, compares the dimming rate indicated by the dimming signal with the luminance set value for each frame, increases the luminance set value by a predetermined value when the dimming rate is larger than the luminance set value, decreases the luminance set value by a predetermined value when the dimming rate is smaller than the luminance set value, and sets the luminance set value to a value of the maximum luminance output when the sudden brightness change signal indicating that the state has been detected is received from the sudden brightness change detection unit.

3. The image display apparatus according to claim 1, wherein the sudden brightness change detection unit includes:

n first D flip-flops that are connected in series and that time sequentially store the determination flag by n (≥2) frames;

a NOR gate to which outputs of the plurality of first D flip-flops are input and from which 1 is output only when all the inputs are 0 and otherwise 0 is output;

(n+m) second D flip-flops that are connected in series and that time sequentially store the dimming signal by (n+m (≥2)) frames;

m comparators which are provided for m second D flip-flops on an output stage side among the (n+m) second D flip-flops, each comparator, to which an output of a corresponding second D flip-flop is supplied as one input and the threshold is supplied as another input, outputting 1 only when the one input is smaller than the threshold and otherwise outputting 0;

a first AND gate to which outputs of the m comparators are input, and from which 1 is output only when all the inputs are 1 and otherwise 0 is output; and a second AND gate to which outputs of the NOR gate and the first AND gate are input, and from which 1 is output only when all the inputs are 1 and otherwise 0 is output.

4. The image display apparatus according to claim 1, wherein the dimming rate calculation unit includes:

a histogram acquisition unit that acquires a first histogram that indicates the image data by degrees of each brightness stage for each frame on the basis of the input video signal, and a second histogram having a number of brightness stages that are different from a number of brightness stages of the first histogram;

an analysis unit that determines whether to perform the dimming control on the basis of the second histogram, and outputs a result of the determination as the determination flag; and a dimming level calculation unit that acquires the dimming rate on the basis of the first histogram, and outputs a signal that indicates the dimming rate as the dimming signal.

5. The image display apparatus according to claim 4, wherein the number of brightness stages for the second histogram is smaller than the number of brightness stages of the first histogram.

6. A method for dimming a light source for an image display apparatus which includes: the light source; and a display unit that spatially modulates a light from the light source on a basis of an input video signal to form an image, and which performs dimming control for adjusting luminance of the light source in stages, the method comprising:

determining whether to perform dimming control on the basis of the input video signal;

acquiring a dimming rate which is a ratio of brightness of an input image to a maximum luminance output from the light source; and setting the luminance of the light source to be maximum when a dimming rate of a frame immediately before a frame determined not to be subjected to dimming control is lower than a threshold, wherein the light source dimming includes:

acquiring a luminance distribution of an image indicated by image data for each frame, determining whether to perform the dimming control on the basis of the luminance distribution to output a determination flag that indicates a result of the determination, and acquiring the dimming rate which is a ratio of brightness of the image to the maximum luminance output of the light source to output a dimming signal that indicates the dimming rate;

determining whether the dimming rate indicated by the dimming signal is lower than the threshold, detecting, on the basis of the determination result and the determination flag, a state where a frame determined not to be subjected to the dimming control follows immediately after a frame whose dimming rate is determined to be lower than the threshold, and outputting a sudden brightness change signal that indicates presence of detection of the state; and adjusting the luminance of the light source in stages on the basis of the dimming signal, and setting an output of the light source to the maximum luminance output when the sudden brightness change signal indicating that the state has been detected is received.

* * * * *